US005354024A

United States Patent [19]

Vinghog et al.

[11] Patent Number: 5,354,024

[45] Date of Patent: Oct. 11, 1994

[54] TRIPOD FOR FIREARMS

[75] Inventors: Geir Vinghøg, Duken; Arne Hagen, Åsgårdstrand, both of Norway

[73] Assignee: Vinghogs Mek. Versted As, Duken, Norway

[21] Appl. No.: 102,595

[22] Filed: Aug. 5, 1993

Related U.S. Application Data

[63] Continuation of Ser. No. 861,782, Jun. 18, 1992, abandoned.

[30] Foreign Application Priority Data

Dec. 15, 1989 [NO] Norway ..... 895080

[51] Int. Cl.[5] ..... F41A 23/00

[52] U.S. Cl. ..... 248/168; 89/37.04; 89/40.06; 248/166; 248/188.5

[58] Field of Search ..... 248/166, 168, 171, 188.7, 248/188.5; 89/37.03, 37.04, 40.06

[56] References Cited

U.S. PATENT DOCUMENTS

| | | | |
|---|---|---|---|
| 906,511 | 12/1908 | Dawson et al. | 89/40.06 |
| 1,372,599 | 3/1921 | Butler | 89/40.06 |
| 1,479,765 | 1/1924 | Whiting | 248/168 |
| 1,560,564 | 11/1925 | Gorton | 89/40.06 |
| 1,594,365 | 8/1926 | Haubroe | 248/168 X |
| 1,670,621 | 5/1928 | Henneveld | 89/40.06 |
| 1,784,264 | 12/1930 | Young | 248/168 X |
| 2,081,929 | 6/1937 | Heavey | 89/40.06 |
| 2,870,683 | 1/1959 | Wilson | 89/37.04 X |
| 3,703,123 | 11/1972 | Horn | 89/40.06 |

*Primary Examiner*—Ramon O. Ramirez
*Assistant Examiner*—Derek J. Berger
*Attorney, Agent, or Firm*—Dressler, Goldsmith, Shore & Milnamow

[57] ABSTRACT

Tripod for firearms, comprising a pivot support (1) having a vertical axis, to the flanges (5,6,7) of which are secured telescopical, adjustable legs (2,3,4), the first flange axis being horizontal enabling the leg (5) to be turned a vertical plane, the second (6) and third (7) flange axis being symmetrical to a vertical plane through the first leg and in a ground view, a front view and a side view being arranged in acute angles to the first leg axis, turning of second and third legs (6,7) thereby amending the angles of those legs in the ground view in relation to the plan of the first leg (2), all legs having the same length. With a fourth, shorter leg (8) on the first leg the distance between the pivot support axis and the first leg's resting point on the surface may be decreased substantially when second (6) and third (7) legs being adjusted in a small acute angle for shooting at ground level in a direction substantially in the longitudinal axis of the first leg (2).

3 Claims, 2 Drawing Sheets

TRIPOD FOR FIREARMS

Figure 1:
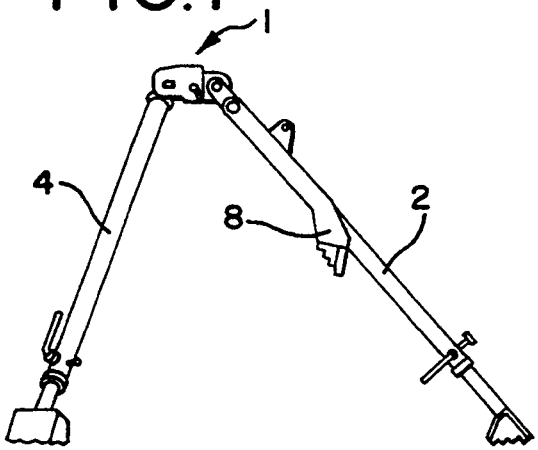

This application is continuation a of application Ser. No. 07/861,782, filed Jun. 18, 1992, now abandoned.

The present invention is related to a tripod for firearms, according to the preamble of the claims.

Tripods for automatic firearms must be designed for easy transport and handling, furthermore they must easily and very quickly be installed and simultaneously such tripods should give a good support for the weapon during use. When firing such weapon on targets in the air, there exists a strong demand for turning the weapon in all directions horizontally as well as inclined hereto. The tripod therefore should give substantially the same support in all directions.

Firing on targets at the ground level usually is performed in the same direction and the tripod therefore preferably should be designed to give a maximum support for recoil forces in the opposite direction.

It is an aim of the present invention to provide a tripod having possibility for installation for firing shots on targets in the air and also directionally firing at the ground level, thereby giving optimized support in both cases. This is achieved with the tripod according to the present invention as described with the features stated in the claims.

The drawing discloses in

FIG. 1 a side view and

Figure 2:
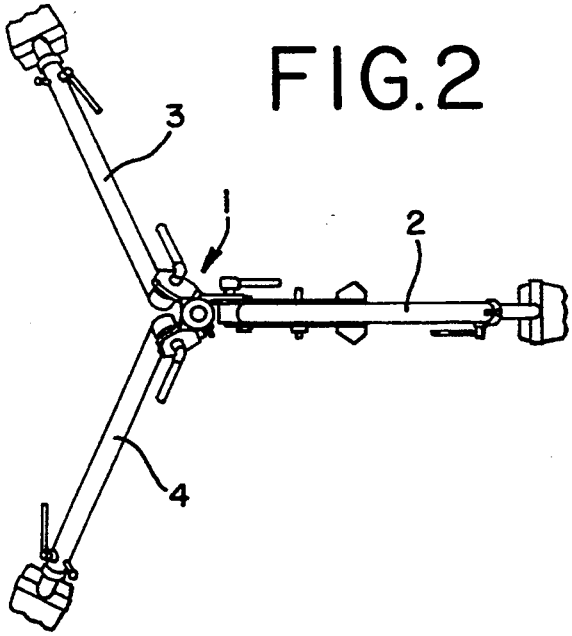
Figure 3:
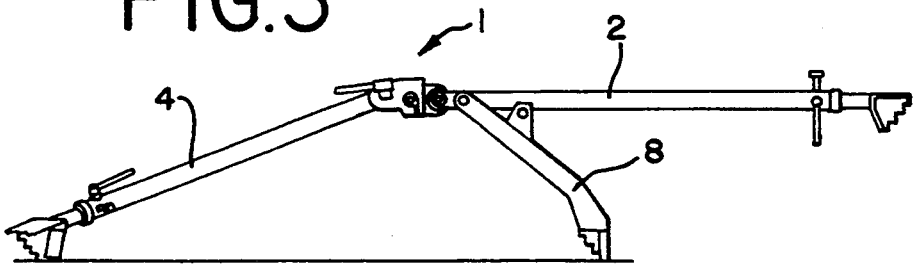
Figure 4:
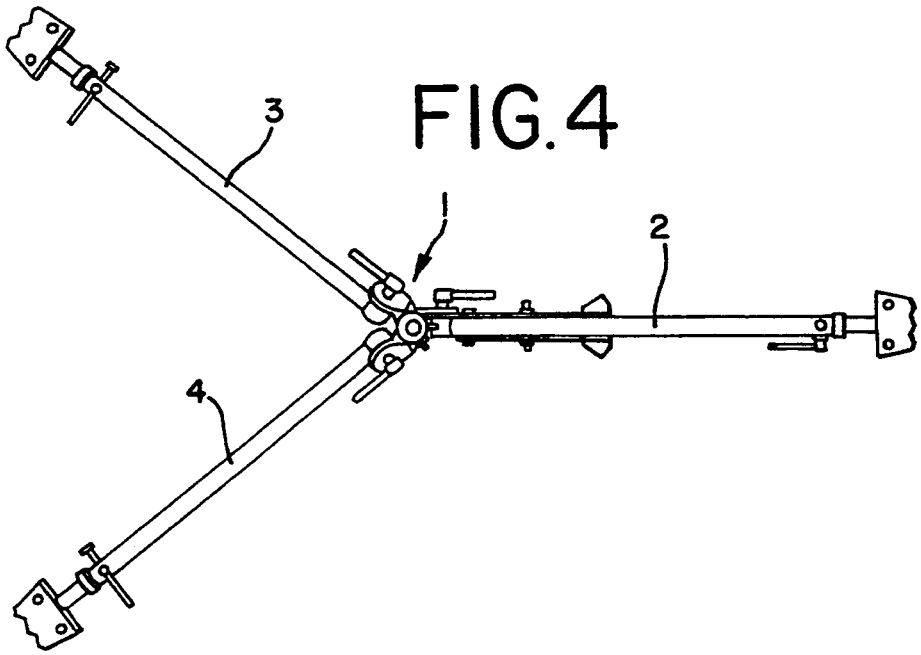
Figure 5:
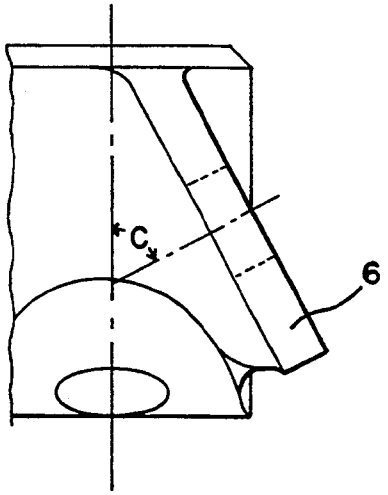
Figure 6:
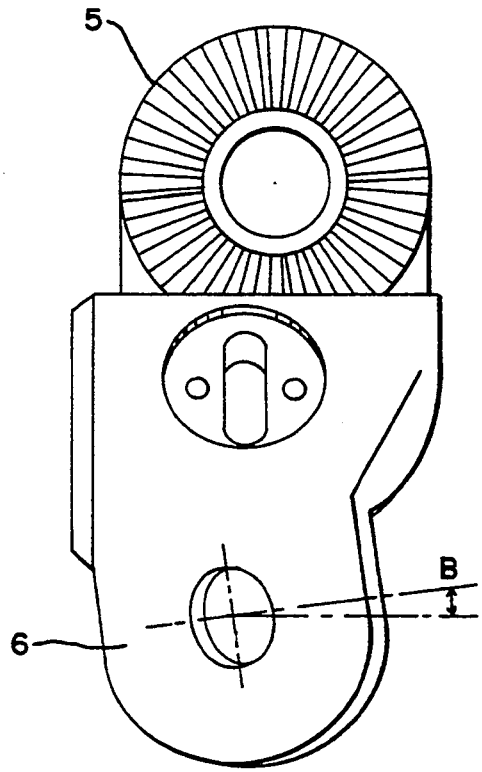
Figure 7:
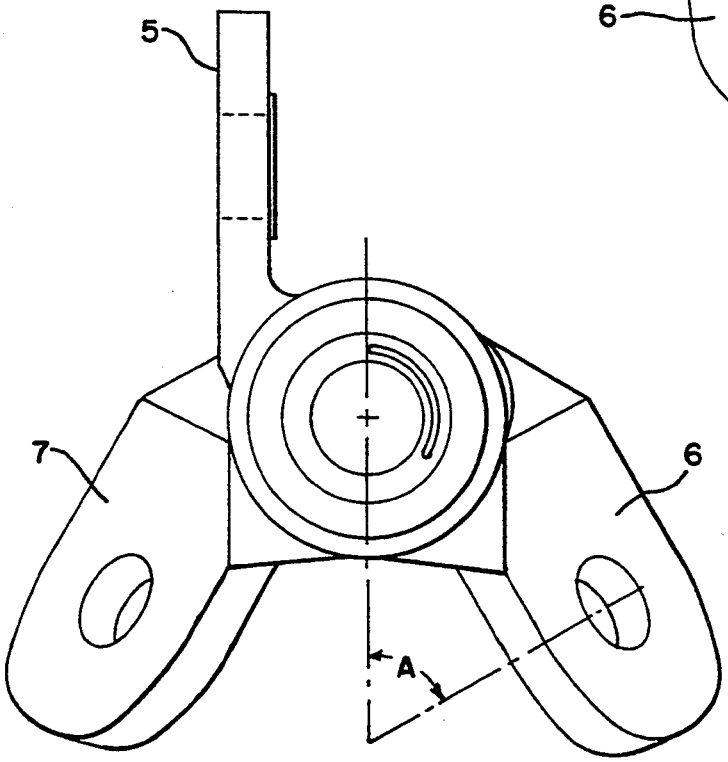

FIG. 2 a ground view of the tripod installed for firing on targets in the air, FIG. 3 discloses a side view and FIG. 4 a ground view of the tripod installed for firing on targets at the ground level, FIG. 5 discloses a section along the arrow V in FIG. 7, FIG. 6 discloses a side view along the arrow VI in FIG. 7 and FIG. 7 discloses a ground view of the pivot support of the tripod.

As disclosed in FIG. 1 and 2 the tripod according to the present invention comprises three legs 2, 3 and 4, all being telescopically extendable to a desired length or position. In one embodiment, the three legs will have the same length. The leg 2 is journalled on a horizontal shaft in a flange 5 fixed to the pivot support 1, enabling leg 2 to be turned in a vertical plane to adjust the angle to the ground and the distance from the pivot support to the resting point on the ground. Legs 3 and 4 are journalled shafts on flanges 6 and 7 respectively fixed to the pivot support 1. Legs 3 and 4 thereby may be turned around symmetrically arranged axes arranged in an angle to a vertical symmetrical plan of the pivot support, with an angle C seen in said plan as disclosed in FIG. 5 and in relation to a plane perpendicularly to the symmetry plane, with an angle B as disclosed in FIG. 6, and finally with an angle A as disclosed in FIG. 7 in the ground view of the pivot support.

Legs 3 and 4 are journalled to the flanges 6 and 7 respectively, which legs 2, 3 and 4 may be adjusted such that the angle between two adjacent legs is 120°. For installing the tripod for firing on targets at the ground level corresponding to FIG. 3 and 4, the legs 3 and 4 are turned towards each other which is made possible by the inclined position of their axes, the leg thereafter being fixed to the flanges 6 and 7. The leg 2 is turned correspondingly in a vertical plane around the axis of the pivot support 1 to a desired position. To ensure that the relatively long support of the leg 2 in front should not give vibrations, a support leg 8 is journalled to the leg 2 near the flange 5. The leg 8 is substantially shorter than the leg 2 and therefore provides a significant support of the tripod in the forward direction, whereas the two legs 3 and 4 receiving the recoil force, are situated relatively far behind the pivot support and relatively close to each other.

We claim:

1. A tripod for firearms comprising a pivot support disposed about a vertical axis and including first, second, and third flanges defining first, second, and third openings, respectively; first, second and third telescoping and adjustable legs, respectively, having resting points and being secured to said first, second, and third flanges, respectively; the axis of the first flange opening being disposed substantially horizontally and means supporting the first leg to said first flange whereby the first leg secured to said first flange is rotatable in a vertical plane, the axes of said second and third flange openings being arranged symmetrically to the vertical plane of the first leg and in a ground view, front view, and side view being arranged in acute angles to the vertical plane of the first leg, means rotatably mounting said second and third legs relative to said second and third flanges, respectively, whereby the rotating of the second and third leg will amend the angles thereof in the ground view relative to the plane of the first leg, the three legs having the same length and the distance between the axis of the pivot support and the resting points of the second and third legs on the surface may be decreased substantially when the second and third legs are adapted to be at an acute angle to each other to insure support when firing at ground level in a direction substantially in a vertical plane through the longitudinal axis of the first leg, and including a fourth leg having a substantially shorter length the other three legs, means connecting the fourth leg to the first leg such that the fourth leg can be moved downward to create a support point substantially nearer the vertical rotation axis of the pivot support than the resting points of the other legs.

2. A tripod in accordance with claim 1 in which the length of the first leg may be telescopically adjusted to a substantially shorter length than said second and third legs to established a resting point for the first leg substantially closer to the pivot support than the resting points of said second and third legs.

3. A tripod as set forth in claim 1 in which the first, second and third legs are disposed at acute angles relative to each other and placed substantially at a 120° from each other.

* * * * *